US008397421B2

(12) United States Patent
Ding et al.

(10) Patent No.: US 8,397,421 B2
(45) Date of Patent: Mar. 19, 2013

(54) QUICK DISCONNECT APPARATUS, ASSEMBLY AND METHOD FOR UTILIZING THE SAME

(75) Inventors: Tai-Lai Ding, Northville, MI (US); Youjin Wu, Westland, MI (US)

(73) Assignee: Leapers, Inc., Livonia, MI (US)

( * ) Notice: Subject to any disclaimer, the term of this patent is extended or adjusted under 35 U.S.C. 154(b) by 127 days.

(21) Appl. No.: 13/074,397

(22) Filed: Mar. 29, 2011

(65) Prior Publication Data

US 2011/0247255 A1 Oct. 13, 2011

Related U.S. Application Data

(60) Provisional application No. 61/322,200, filed on Apr. 8, 2010.

(51) Int. Cl.
*F41G 1/38* (2006.01)

(52) U.S. Cl. ..... 42/124; 42/127

(58) Field of Classification Search ..... 42/90, 124–127, 42/128, 135–139, 148
See application file for complete search history.

(56) References Cited

U.S. PATENT DOCUMENTS

| | | | | |
|---|---|---|---|---|
| 4,310,980 | A | 1/1982 | Pilkington | |
| 4,742,636 | A | 5/1988 | Swan | |
| 4,835,895 | A | 6/1989 | Bowen | |
| 5,680,725 | A | 10/1997 | Bell | |
| 5,787,630 | A | 8/1998 | Martel | |
| 6,442,883 | B1 * | 9/2002 | Waterman et al. | 42/124 |
| 6,931,778 | B1 | 8/2005 | Nelson et al. | |
| 7,107,716 | B1 | 9/2006 | Liao | |
| 7,204,052 | B2 * | 4/2007 | Swan | 42/127 |
| 7,272,904 | B2 * | 9/2007 | Larue | 42/127 |
| 7,562,485 | B2 * | 7/2009 | Newhall et al. | 42/127 |
| 7,757,422 | B1 * | 7/2010 | Swan | 42/96 |
| 7,802,395 | B1 * | 9/2010 | Swan | 42/127 |
| 8,112,933 | B1 * | 2/2012 | Swan | 42/127 |
| 2006/0123686 | A1 * | 6/2006 | Larue | 42/127 |
| 2008/0168696 | A1 | 7/2008 | Orne et al. | |
| 2008/0178511 | A1 * | 7/2008 | Storch et al. | 42/90 |
| 2008/0216380 | A1 | 9/2008 | Teetzel | |
| 2009/0000174 | A1 * | 1/2009 | Davis et al. | 42/90 |
| 2009/0205241 | A1 * | 8/2009 | Kiser | 42/135 |
| 2011/0146128 | A1 | 6/2011 | Haering | |
| 2012/0167438 | A1 * | 7/2012 | Daniel et al. | 42/90 |
| 2012/0210624 | A1 * | 8/2012 | Schneider et al. | 42/90 |

* cited by examiner

*Primary Examiner* — Samir Abdosh
(74) *Attorney, Agent, or Firm* — Honigman Miller Schwartz and Cohn LLP

(57) ABSTRACT

A quick disconnect apparatus is disclosed. The quick disconnect apparatus includes a base member, a rail clamp member and a rail clamp adjustment device. The base member includes at least one passage. The rail clamp member includes a support bar receiving passage. The rail clamp member is movably-coupled to the base member. The rail clamp adjustment device is coupled to at least one of the base member and rail clamp member. The rail clamp adjustment device includes a pivot pin, a cam member including at least one offset passage and a support bar including a pivot-pin receiving passage. The support bar is inserted through the support bar receiving passage of the rail clamp member and a passage of the at least one passage of the base member to movably-couple the rail clamp member with the base member. The pivot pin is inserted through the at least one offset passage of the cam member and the pivot-pin receiving passage of the support bar to rotatably-couple the cam member relative the support bar. The cam member includes at least one cam surface. The rail clamp member includes an outer surface. The at least one cam surface engages the outer surface of the rail clamp member.

19 Claims, 14 Drawing Sheets

FIG. 13
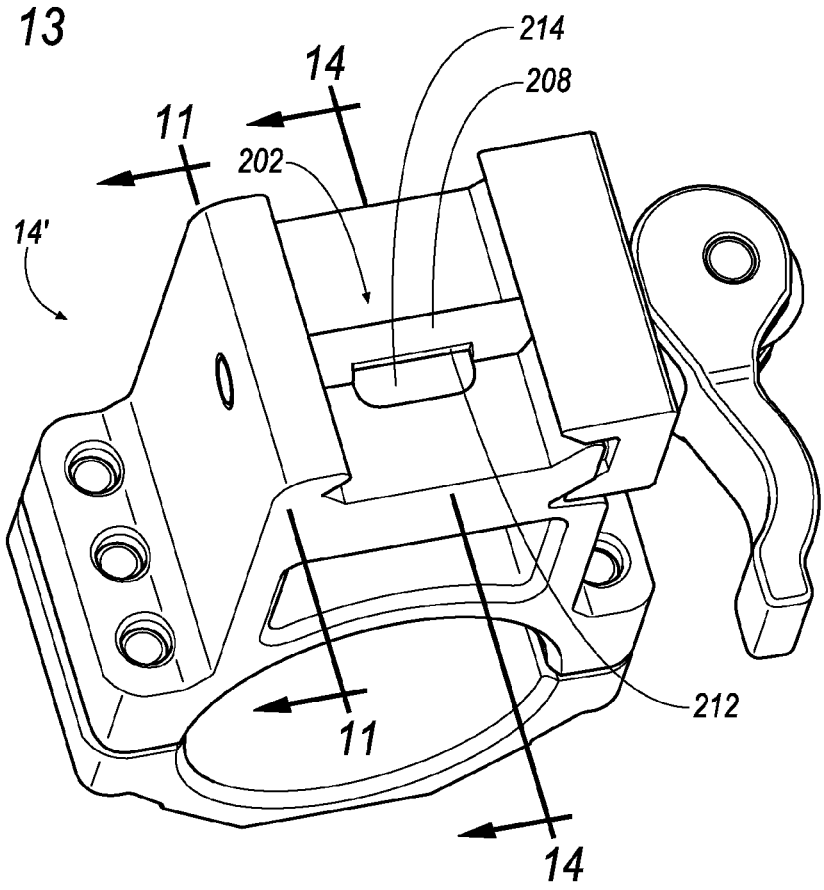
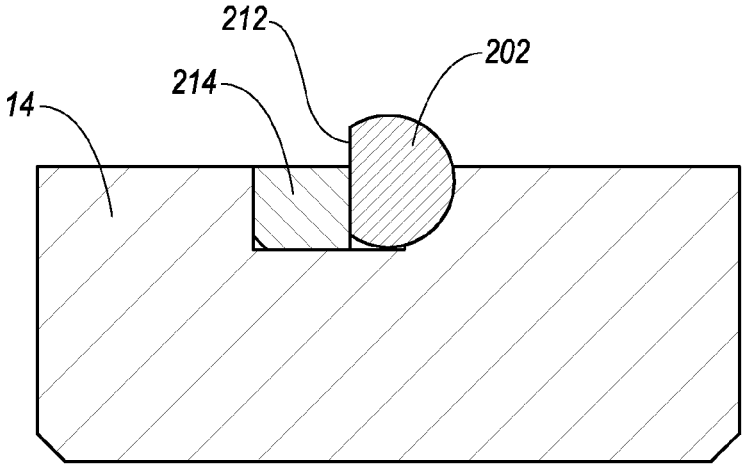
FIG. 14

FIG. 16
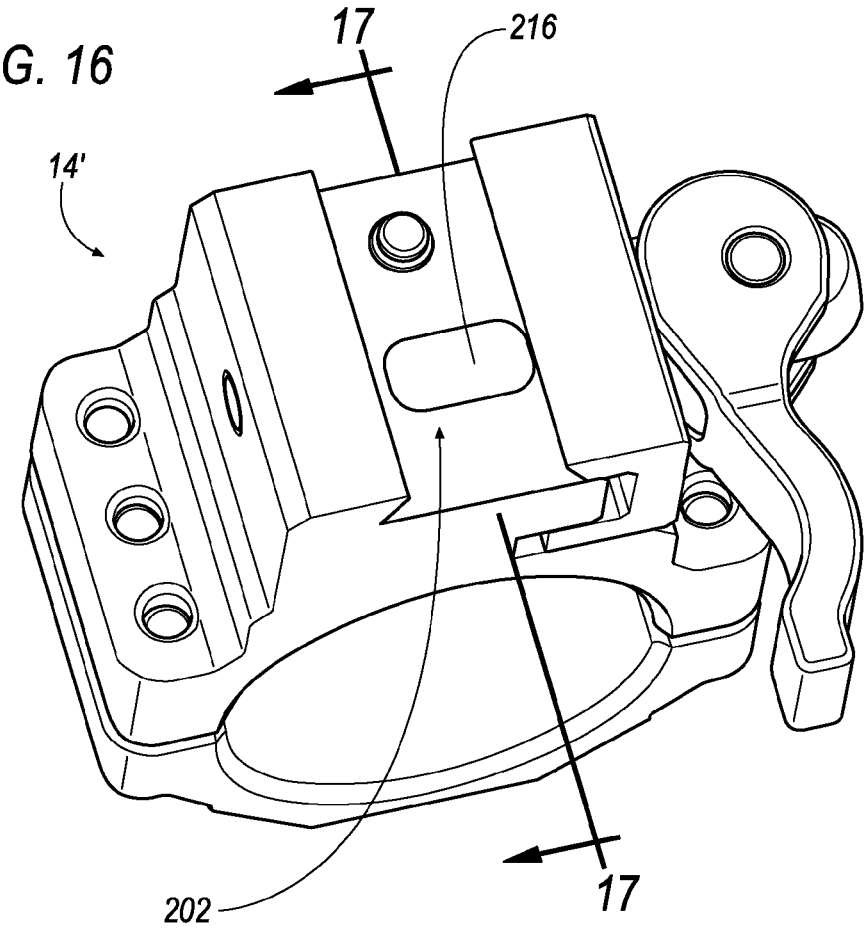
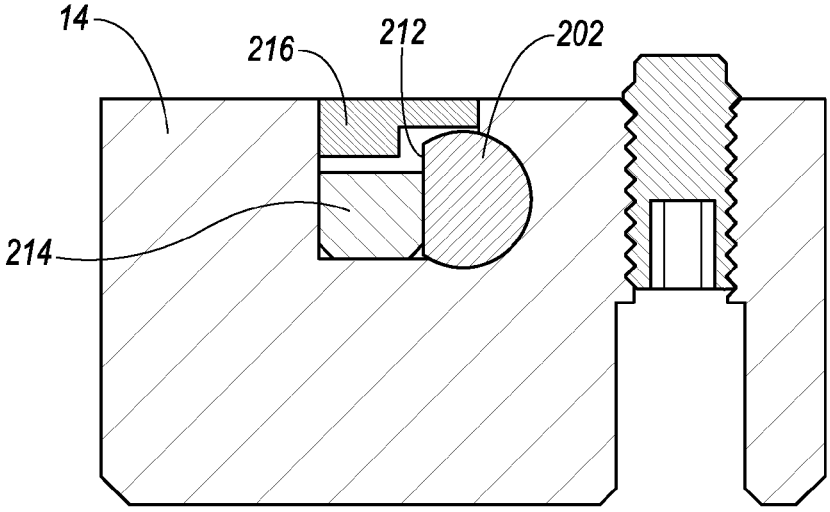
FIG. 17

QUICK DISCONNECT APPARATUS, ASSEMBLY AND METHOD FOR UTILIZING THE SAME

RELATED APPLICATION

This application claims the benefit of U.S. Provisional Application Ser. No. 61/322,200 filed on Apr. 8, 2010, which is entirely incorporated herein by reference.

FIELD OF THE INVENTION

The disclosure relates to a quick disconnect apparatus, assembly and method for utilizing the same.

DESCRIPTION OF RELATED ART

Firearms may include rails for mounting accessories. Rails, however, are known to include different tolerances/geometries. Therefore, a need exists in the art for the development of improved apparatuses and methodologies that compensate for different tolerances/geometries of rails.

BRIEF DESCRIPTION OF THE DRAWINGS

The disclosure will now be described, by way of example, with reference to the accompanying drawings, in which:

FIG. 13 illustrates a cross-sectional view of the quick disconnect apparatus in accordance with an exemplary embodiment of the invention;

FIG. 14 illustrates a front, partial cross-sectional view of the quick disconnect apparatus according to line 14-14 of FIG. 13 in accordance with an exemplary embodiment of the invention;

FIG. 16 illustrates a cross-sectional view of the quick disconnect apparatus in accordance with an exemplary embodiment of the invention; and FIG. 17 illustrates a front, partial cross-sectional view of the quick disconnect apparatus according to line 16-16 of FIG. 16 in accordance with an exemplary embodiment of the invention.

DETAILED DESCRIPTION OF THE INVENTION

The Figures illustrate an exemplary embodiment of a quick disconnect apparatus, assembly and method for utilizing the same. Based on the foregoing, it is to be generally understood that the nomenclature used herein is simply for convenience and the terms used to describe the invention should be given the broadest meaning understood by one of ordinary skill in the art.

Figure 1:
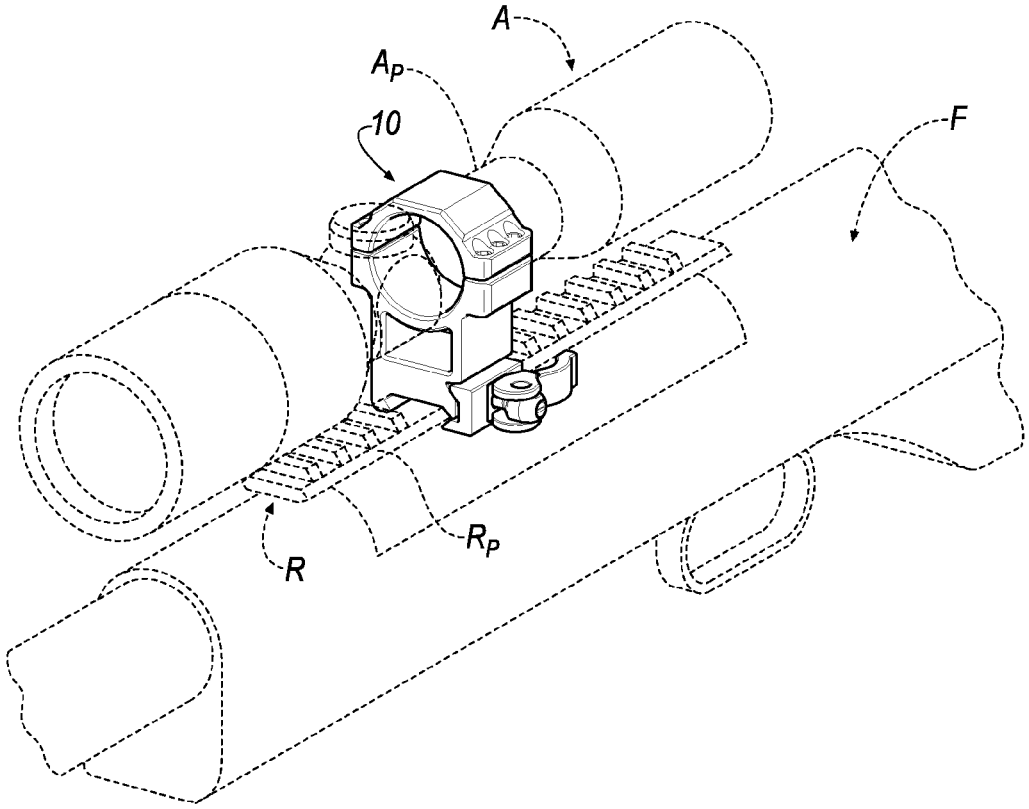
FIG. 1 is a view of a quick disconnect apparatus connected to a rail of a firearm in accordance with an exemplary embodiment of the invention.
Figure 2:
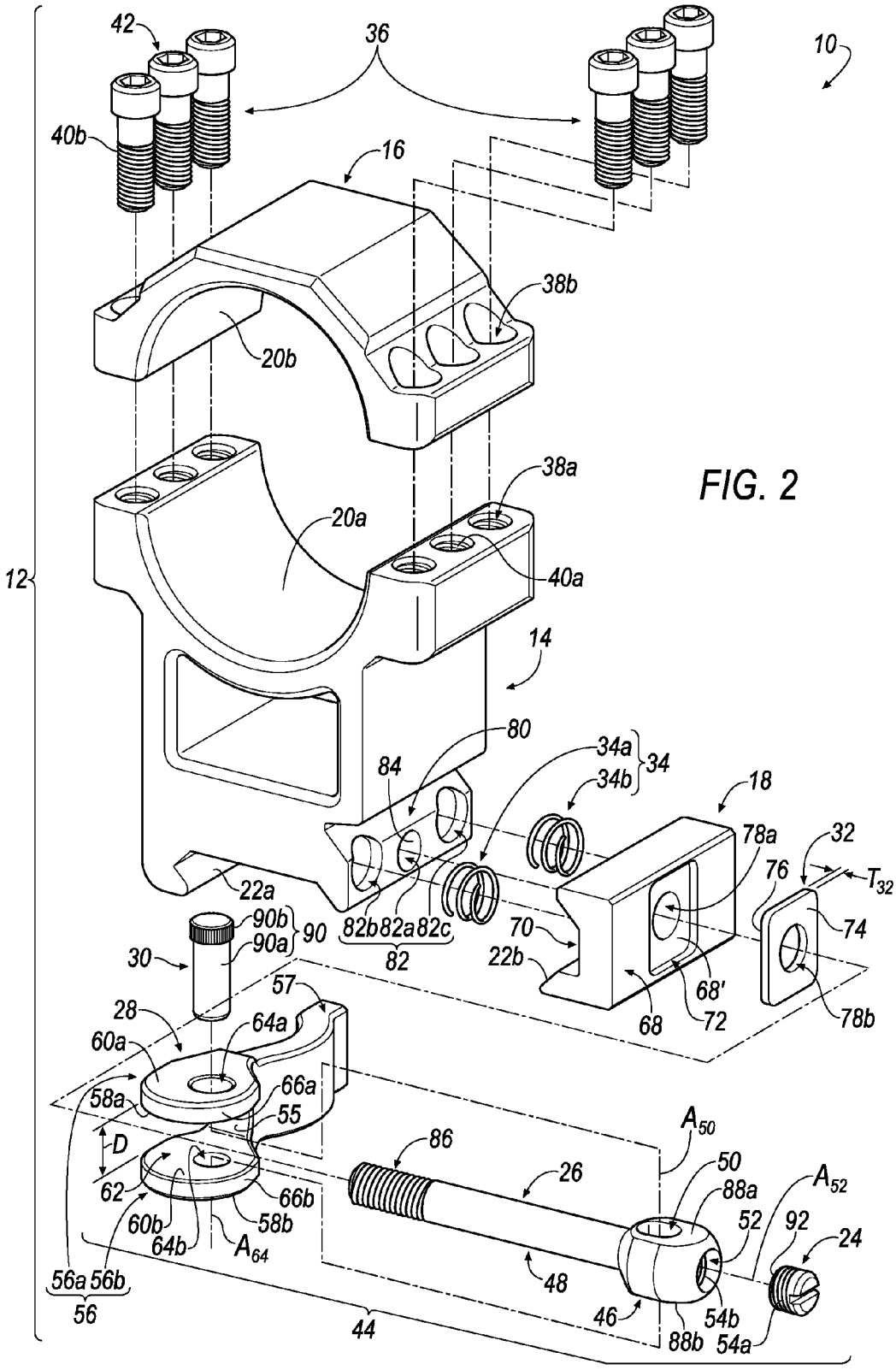
FIG. 2 is an exploded perspective view of a quick disconnect apparatus in accordance with an exemplary embodiment of the invention.

Referring to FIG. 1-4, a quick disconnect apparatus is shown generally at 10 in accordance with an exemplary embodiment of the invention. As seen in FIG. 2, the quick disconnect apparatus 10 is an assembly that is formed by the joining/connection of a plurality of components 12. In an embodiment, the plurality of components 12 include at least: a base member 14, an accessory clamp member 16 and a rail clamp member 18.

In an embodiment, the accessory clamp member 16 may be removably-coupled to the base member 14. Further, in an embodiment, the base member 14 and accessory clamp member 16 may each include a surface profile/geometry 20*a*, 20*b* that generally conforms to a portion of an outer surface profile/geometry, $A_P$, of an accessory, A (see, e.g., FIG. 1). Accordingly, it will be appreciated that upon locating the portion of the outer surface profile, $A_P$, of the accessory, A, proximate one or more of the surface profile/geometry 20*a*, 20*b* of one or more of the base member 14 and accessory clamp member 16, the coupling of the base member 14 and the accessory clamp member 16 may result in a selective coupling of the accessory, A, to the base member 14 and accessory clamp member 16.

In an embodiment, the rail clamp member 18 may be removably-coupled to the base member 14. Further, in an embodiment, the base member 14 and rail clamp member 18 may each include a surface profile/geometry 22*a*, 22*b* that generally conforms to a portion of an outer surface profile/geometry, $R_P$, of a rail, R (see, e.g., FIG. 1). Accordingly, it will be appreciated that upon locating the portion of the outer surface profile, $R_P$, of the rail, R, proximate one or more of the surface profile/geometry 22*a*, 22*b* of one or more of the base member 14 and rail clamp member 18, the coupling of the base member 14 and the rail clamp member 18 may result in a selective coupling of the base member 14 and rail clamp member 18 to the rail, R. Further, in an embodiment, when the quick disconnect apparatus 10 is said to be arranged in the "clamped orientation" relative the rail, the combination of the surface profiles/geometries 22*a*, 22*b* of the base member 14 and rail clamp member 18 may form a dove-tail-receiving passage or gap that conforms to a dovetail outer surface profile/geometry, $R_P$, of the rail, R.

Referring to FIG. 1, in an embodiment, the rail, R, may be attached to or otherwise comprises a portion of a body of a firearm, F. In an embodiment, the rail, R, may include any desirable rail having any desirable geometry; however, in an embodiment, the rail, R, may include, for example, a "Picatinny" rail. In an embodiment, the firearm, F, is not limited to including a particular firearm, and, as such, the firearm, F, may include but is not limited to any projectile-directing device such as, for example: a rifle, handgun, archery bow, paint-ball gun or like. Although one or more rails, R, may be attached to firearms, F, as described above, it will be appreciated that the one or more rails, R, are not necessarily limited to being attached to firearms, F; for example, the one or more rails, R, may be attached to any desirable apparatus or device, such as, for example, a vehicle, a pair of binoculars, a visor, or the like.

Referring back to FIG. 2, an embodiment of the plurality of components 12 for forming the quick disconnect apparatus 10 may further include: an adjustment member 24, a support bar 26, a cam member 28, a pivot pin 30, a relief plate 32, one or more biasing members 34 and one or more fasteners 36. Although the plurality of members 12 is shown and described to include the components 14-36, it will be appreciated that the plurality of members 12 forming the quick disconnect apparatus 10 is not specifically limited to the illustrated embodiments and that other equivalents may be utilized in substitution-of or in addition-to the components 14-36.

In an embodiment, the one or more fasteners 36 may be utilized to removably-couple the accessory clamp member 16 to the base member 14. In an embodiment, the one or more fasteners 36 may be inserted through one or more passages 38*a*, 38*b* formed by each of the base member 14 and the accessory clamp member 16. In an embodiment, the one or more passages 38*a* formed by the base member 14 may include a threaded surface 40*a*. In an embodiment, the one or more fasteners 36 may include a threaded surface 40*b* that correspondingly-engages the threaded surface 40*a* of the base member 14 for retaining the accessory clamp member 16 to the base member 14 while also removably-securing the one or more fasteners 36 to the base member 14.

In an embodiment, a tool (not shown) may be engageable with an end 42 of each of the one or more fasteners 36. In an embodiment, the tool may be utilized for rotating the one or more fasteners 36 for the purposes of threadingly-engaging/threadingly-disengaging the threaded surfaces 40*a*, 40*b*. In an embodiment, the end 42 of each of the one or more fasteners 36 may include a recess having a multi-faceted surface that corresponds to a multi-faceted exterior surface of the tool (e.g., an Allen wrench or the like). Though threaded engagement was exemplarily described, other connection means may be employed and the invention should not be so limited thereby.

In an embodiment, one or more of the adjustment member 24, the support bar 26, the cam member 28 and the pivot pin 30 may be referred to as a rail clamp adjustment device 44. As will be explained with relation to FIGS. 5A-7B, a user may manipulate the orientation of one or more of the adjustment member 24, the support bar 26, the cam member 28 and the pivot pin 30 in order to: (1) selectively-couple the rail clamp member 18 to the base member 14 (2) manipulate an orientation of the clamp member 18 relative the base member 14 and (3) compensate for a difference in geometry/tolerance of the rail, R (in comparison to a geometry/tolerance of other rails). In an implementation, the one or more of the adjustment member 24 is a pin-adjusting screw.

Figure 6:
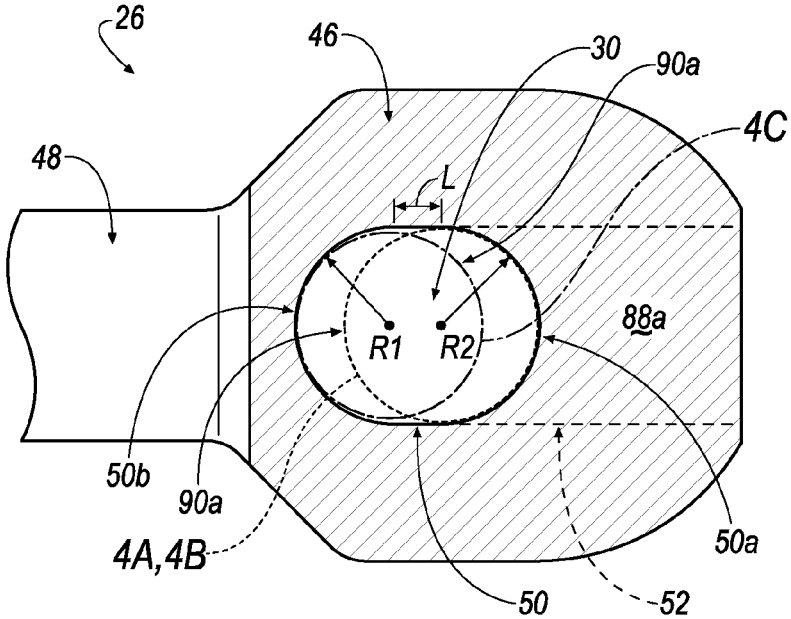
FIG. 6 illustrates a partial cross-sectional view of a component of a quick disconnect apparatus according to line 6-6 of FIG. 5C in accordance with an exemplary embodiment of the invention.

With reference to FIG. 2, an embodiment of the clamping adjustment device 44 is described. In an embodiment, the support bar 26 includes a head portion 46 connected to a stem portion 48. In an embodiment, the head portion 46 includes a first passage 50 and a second passage 52. An embodiment of a partial top, cross-sectional view of the head portion 46 is also shown in FIG. 6.

Referring to FIG. 2, in an embodiment, a first axis, $A_{50}$, extends through the first passage 50 of the head portion 46. In an embodiment, a second axis, $A_{52}$, extends through the second passage 52 of the head portion 46. In an embodiment, the first axis, $A_{50}$, and the second axis, $A_{52}$, may intersect. In an embodiment, as also seen in FIGS. 5A-5C and 7A-7B, the first and second passages 50, 52 may intersect such that the first passage 50 may be said to be in communication with the second passage 52.

Referring to FIG. 2, in an embodiment, the adjustment member 24 may be removably-coupled to the support bar 26. In an embodiment, the adjustment member 24 may include an outer surface 54*a*. In an embodiment, the second passage 52 is formed by an inner surface 54*b*. In an embodiment, at least a portion of each of the surfaces 54*a*, 54*b* include connection means (e.g., threads) that permit the surfaces 54*a*, 54*b* to engage one-another for removably-coupling the adjustment member 24 at least proximate the head portion 46 of the support bar 26.

In an embodiment, the cam member 28 may include a base member 55, at least one flange 56 extending from the base member 55 and a lever member 57 extending from the base member 55. In an embodiment, the at least one flange 56 may include a first flange 56*a* and a second flange 56*b*. In an embodiment the first and second flanges 56*a*, 56*b* may be referred to as a pair of flanges 56.

Figure 3:
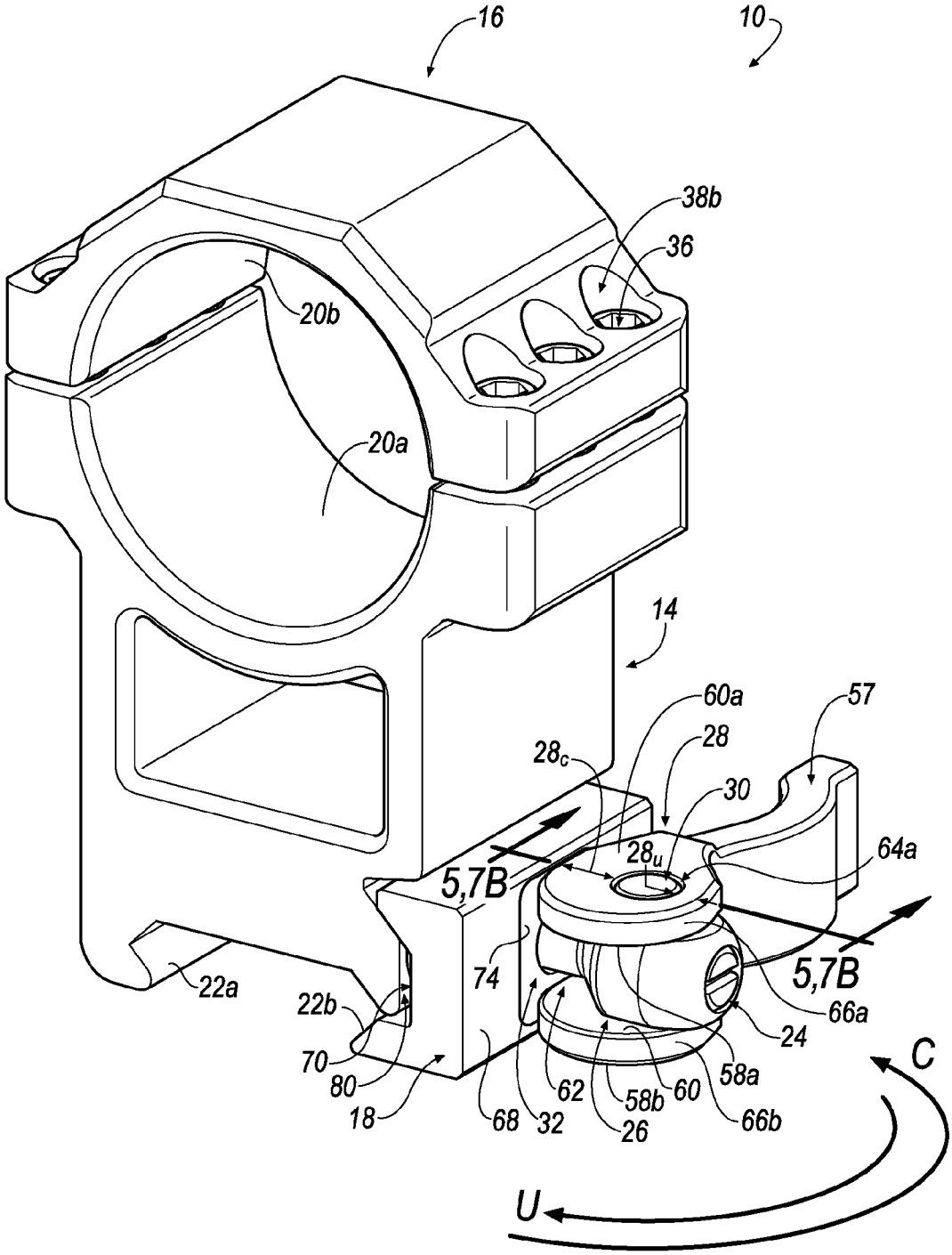
FIG. 3 is an assembled view of the quick disconnect apparatus of FIG. 2 in accordance with an exemplary embodiment of the invention.
Figure 4:
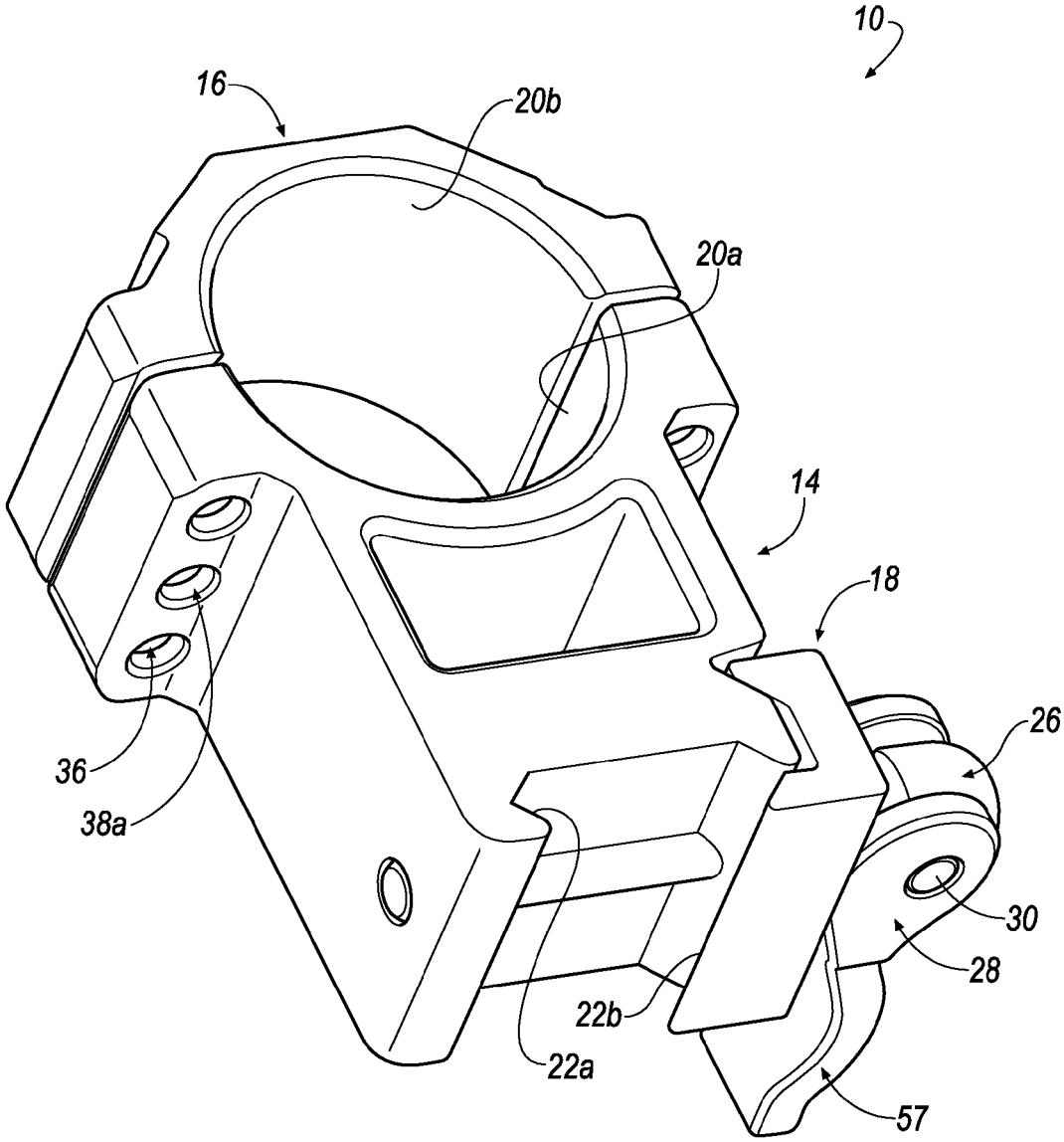
FIG. 4 is an assembled view of the quick disconnect apparatus of FIG. 2 in accordance with an exemplary embodiment of the invention.

In an embodiment, a lower surface 58*a* of the first flange 56*a* is spaced apart from an upper surface 60*b* of the second flange 56*b* by a distance, D. In an embodiment, the spaced-apart relationship, D, of the first and second flanges 56*a*, 56*b* forms a void, recess, gap 62 or the like. As depicted in FIG. 3, in an implementation, the head portion 46 may be arranged within the gap 62 in order to permit the support bar 26 to be connected to the cam member 28.

In an embodiment, each of the first and second flanges 56*a*, 56*b* are formed to include a substantially similar geometry. In an embodiment, the first flange 56*a* is formed to include a first opening/passage 64*a*. In an embodiment, the second flange 56*b* is formed to include a second opening/passage 64*b*. In an embodiment, the openings/passages 64*a*, 64*b* extend through each of the first and second flanges 56*a*, 56*b* between the lower and upper surfaces 58*a*, 60*a*/58*b*, 60*b* of each of the first and second flanges 56*a*, 56*b*. In an embodiment, one or both of the openings 64*a*, 64*b* may be located at a position on respective first and second flanges 56*a*, 56*b* that is offset with respect to an axis or center of the flanges 56.

In an embodiment, as also seen in FIGS. 5A-5C and 7A-7B, the openings/passages 64*a*, 64*b* of each of the first and second flanges 56*a*, 56*b* are axially-aligned according to an axis, $A_{64}$. However, as also seen in FIGS. 4A-4C and 6A-6B, the first opening/passage 64*a* may include a diameter that is slightly greater than a diameter of the second opening/passage 64*b*.

Further, in an embodiment, each of the first and second flanges 56*a*, 56*b* are formed to include a cam surface 66*a*, 66*b*. As will be explained in connection with FIGS. 5A-5C and 7A-7B, the cam surfaces 66*a*, 66*b* may contact/engage the relief plate 32.

In an embodiment, the rail clamp member 18 includes an outer surface 68 and an inner surface 70. In an embodiment, the outer surface 68 may include a recess or depression 72; accordingly, in an embodiment, the recess or depression 72 may further define the outer surface 68 of the rail clamp member 18 to include a recessed outer surface portion 68'.

In an embodiment, the relief plate 32 may include an outer surface 74 and an inner surface 76. In an embodiment, the relief plate 32 may be arranged substantially adjacent the outer surface 68 of the rail clamp member 18. It will be appreciated, however, that if the relief plate 32 is not included in the design of a quick disconnect member 10, the rail clamp member 18 may not include the recessed outer surface portion 68' the cam surfaces 66*a*, 66*b* of the cam member 28 may directly engage the outer surface 68 of the rail clamp member 18 rather than indirectly engaging the rail clamp member 18 by way of the relief plate 32.

In an embodiment, the recess or depression 72 may include a geometry that is substantially similar to the geometry of the relief plate 32. In an embodiment, the recess or depression 72 includes a depth geometry that corresponds to a thickness, $T_{32}$, of the relief plate 32 such that the relief plate 32 may be disposed within the recess or depression 72. In an embodiment, upon arranging the relief plate 32 within the recess or depression 72, the inner surface 76 of the relief plate 32 may be arranged substantially adjacent the recessed outer surface portion 68' of the rail clamp member 18. Further, in an embodiment, upon arranging the relief plate 32 within the recess or depression 72, the outer surface 74 of the relief plate 32 may be aligned with/substantially co-planar with the outer surface 68 of the rail clamp member 18.

In an embodiment, the rail clamp member 18 may include a passage 78*a*. In an embodiment, as also seen in FIGS. 5A-5C and 7A-7B, the passage 78*a* extends at least between the recessed outer surface portion 68' and the inner surface 70 of the rail clamp member 18.

In an embodiment, the relief plate 32 may include a passage 78*b*. In an embodiment, as also seen in FIGS. 5A-5C and 7A-7B, the passage 78*b* extends between the outer surface 74 and the inner surface 76 of the relief plate 32.

In an embodiment, the passages 78*a*, 78*b* of the rail clamp member 18 and the relief plate 32 may include a similar geometry and may be generally coaxially-aligned with one-another. As seen in the illustrated embodiment of FIGS. 5A-5C and 7A-7B, the stem portion 48 of the support bar 26 may be inserted through each of the passages 78*a*, 78*b*.

In an embodiment, the base member 14 includes a rail clamp engagement surface 80. In an embodiment, the rail clamp engagement surface 80 includes a surface geometry that permits corresponding contact/engagement with a surface geometry of at least a portion of the inner surface 70 of the rail clamp member 18.

In an embodiment, the base member 14 includes one or more, or a plurality, of recesses 82. In an embodiment, the recesses 82 may includes a first recess 82*a*. In an embodiment, the first recess 82*a* may include a similar geometry to and may be generally coaxially-aligned with the passages 78*a*, 78*b* of the rail clamp member 18 and the relief plate 32. In an embodiment, the first recess 82*a* includes an inner surface 84.

Figure 10:
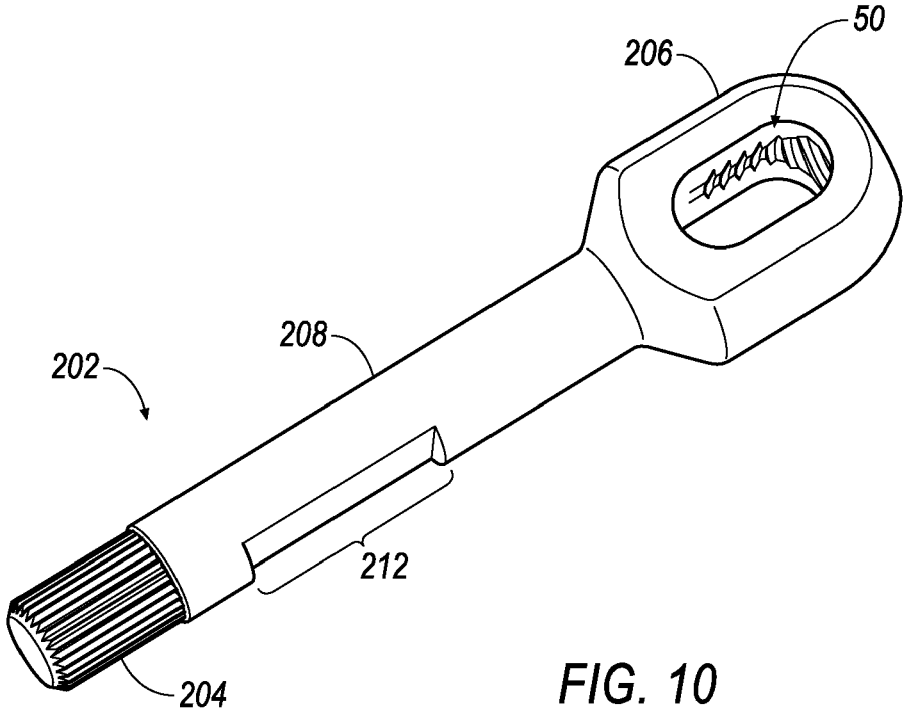
FIG. 10 illustrates a support bar in accordance with an exemplary embodiment of the invention.
Figure 11:
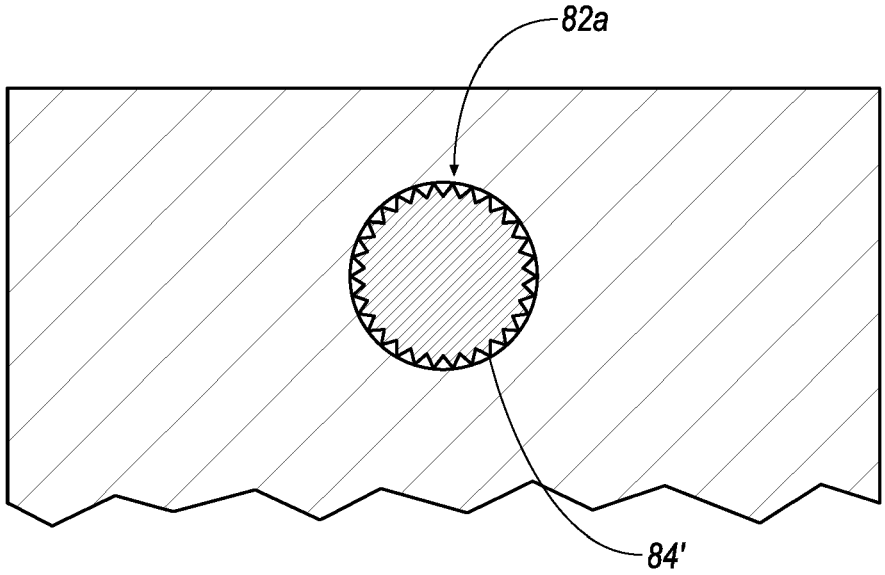
FIG. 11 illustrates a cross-sectional view of a support bar resident within a recess
Figure 12:
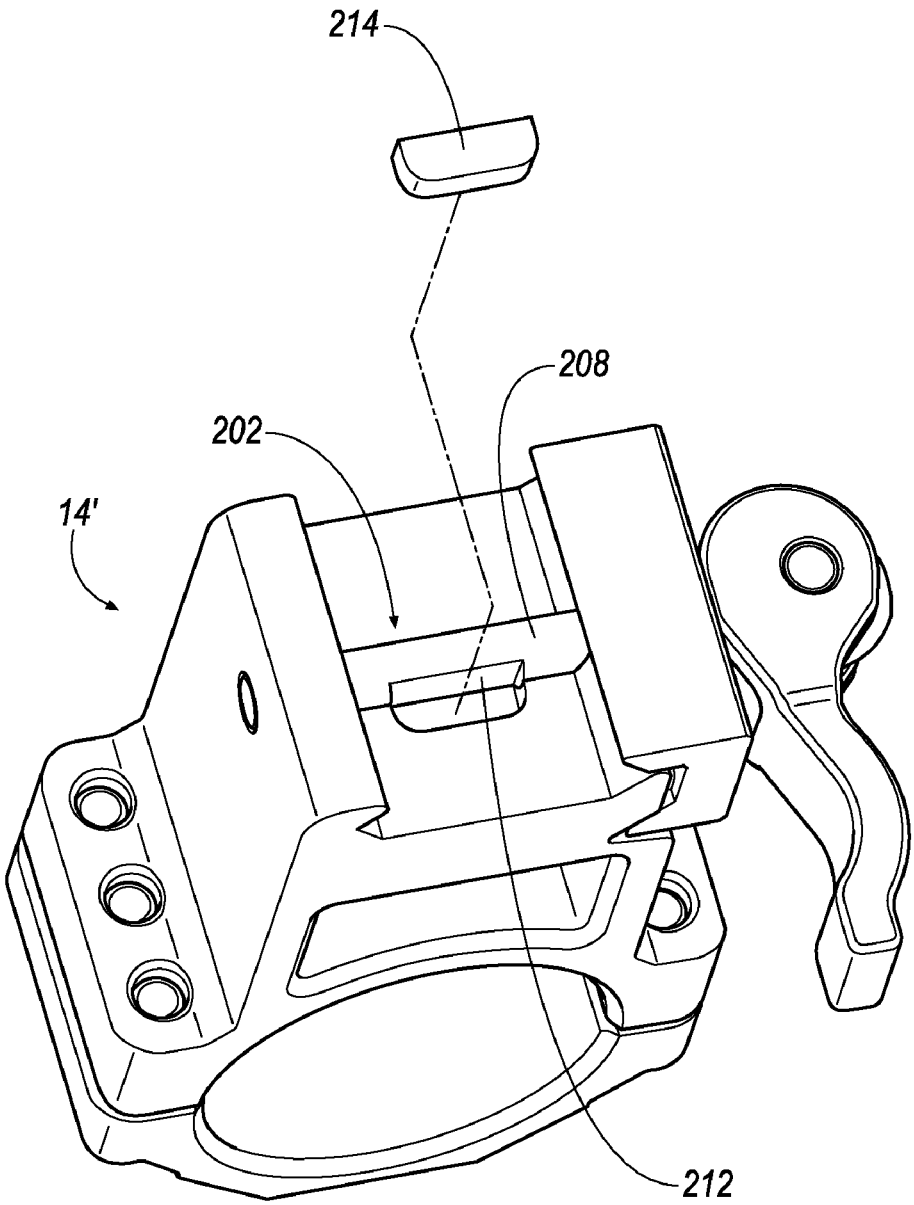
FIG. 12 illustrates a partial view of the quick disconnect apparatus in accordance with an exemplary embodiment of the invention.
Figure 15:
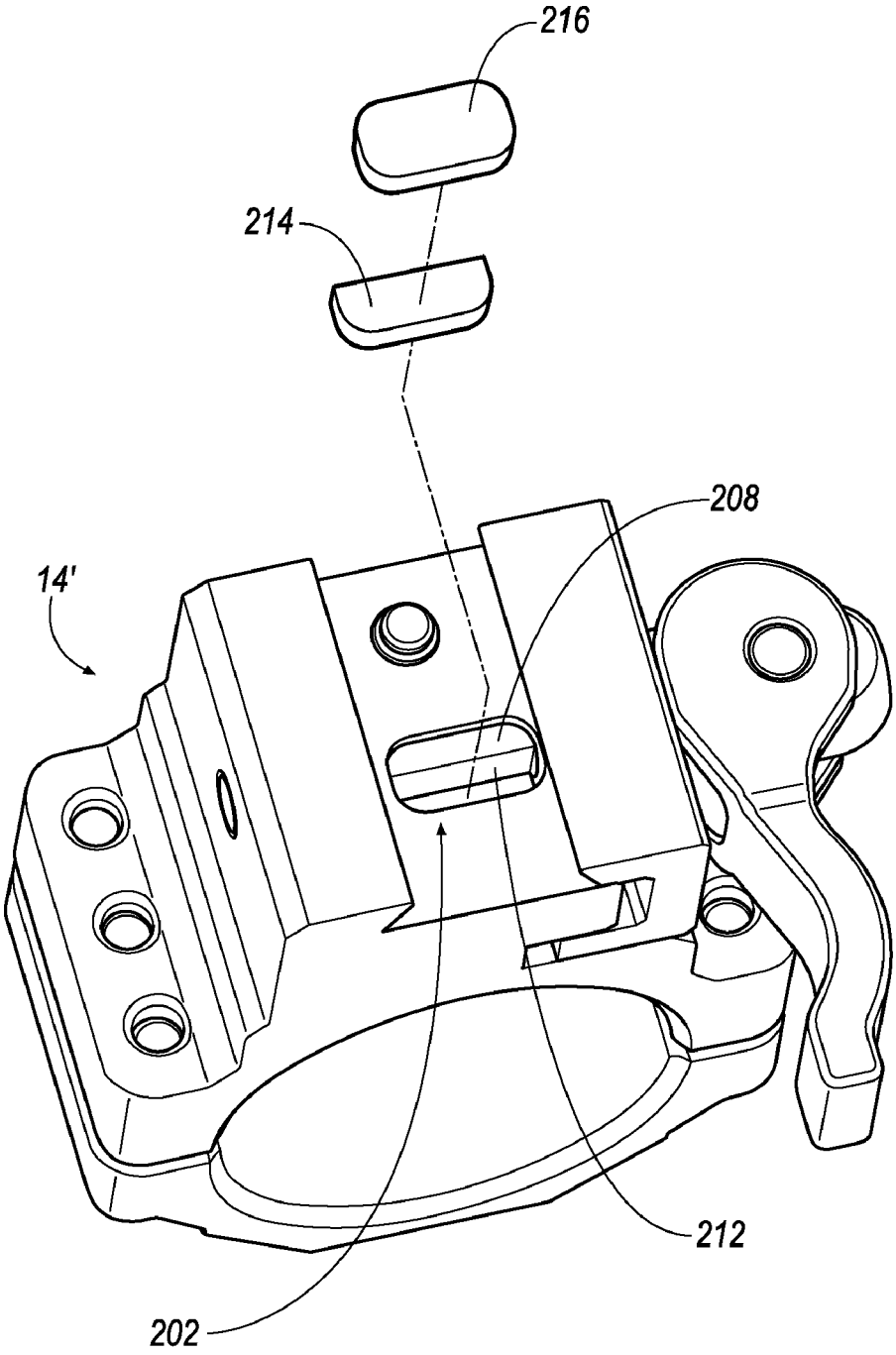
FIG. 15 illustrates a cross-sectional view of the quick disconnect apparatus in accordance with an exemplary embodiment of the invention.

In an embodiment, the surfaces 84, 86 are adapted to permit the support bar 26 to be coupled to the base member 14. That is, in an implementation, at least a portion of the inner surface 84 includes a mating surface that correspondingly mates with at least a portion of a surface 86 of the stem portion 48 of the support bar 26. In the embodiment shown in FIG. 2, surface 86 is threaded and, accordingly, inner surface 84 is adapted to engage the threads of surface 86. As will be discussed in more detail below, FIG. 10 depicts an alternate embodiment showing that surface 86 of the stem portion 48 may be knurled or otherwise splined and inner surface 84 includes a corresponding surface to provide a friction engagement between surface 86 and inner surface 84 as depicted in FIG. 11.

In an embodiment, the plurality of recesses 82 may further include one or more spring-receiving recesses, which are shown generally at 82*b*, 82*c*. In an embodiment, the one or more bias-receiving recesses 82*b*, 82*c* include a first bias-receiving recess 82*b* and a second bias-receiving recess 82*c*.

In an embodiment, the one or more biasing members 34 include a first biasing spring member 34*a* and a second biasing spring member 34*b*. In an embodiment, the first biasing spring 34*a* may be arranged within the first recess 82*b* and the second biasing spring member 34*b* may be arranged within the recess 82*c*. Other biasing arrangements may be contemplated and the invention should not limited to the disclosed embodiment.

An embodiment of a methodology/assembling procedure for movably-coupling the rail clamp member 18 to the base member 14 is now described. It will be appreciated the following description is an embodiment of assembling one or more portions of the quick disconnect apparatus 10 and that other embodiments for assembling one or more portions of the quick disconnect apparatus 10 may also be practiced.

In an embodiment, the first and second biasing members 34*a*, 34*b* are at least partially disposed within/generally aligned with the first and second recesses 82*b*, 82*c* of the base member 14. It will be appreciated that upon at least partially disposing/generally aligning the first and second spring members 34*a*, 34*b* within/with first and second recesses 82*b*, 82*c*, the first and second members 34*a*, 34*b* may be said to be in an un-biased, extended state such that at least a portion of the length of each of the first and second biasing members 34*a*, 34*b* may extend beyond the rail clamp engagement surface 80 of the base member 14.

Next, the inner surface 70 of the rail clamp member 18 may be located substantially adjacent/proximate the rail clamp engagement surface 80 of the base member 14. Before, during or after the inner surface 70 of the rail clamp member 18 being located substantially adjacent the rail clamp engagement surface 80 of the base member 14, the inner surface 70 of the rail clamp member 18 may come into contact with/engage a portion of the length of the first and second biasing spring members 34*a*, 34*b* that may extend at least partially beyond the rail clamp engagement surface 80 of the base member 14. Accordingly, upon a subsequent locating of the inner surface 70 of the rail clamp member 18 closer to the rail clamp engagement surface 80 (e.g., by movement of the lever 57 of the cam member 28 according to the direction of the arrow, C (FIG. 3), as will be described in the foregoing disclosure at FIGS. 7A-7B), the first and second biasing members 34*a*, 34*b* may be compressed between the base member 14 and the rail clamp member 18 such that the first and second biasing members 34*a*, 34*b* may be re-orientated from the un-biased orientation (see, e.g., FIGS. 5A-5C, 7A) to a biased orientation (see, e.g., FIG. 7B) within the first and second recesses 82*b*, 82*c* such that some or all of the portion of the length of each of the first and second biasing members 34*a*, 34*b* no longer extend beyond the rail clamp engagement surface 80 of the base member 14. Further, before, during or after locating the inner surface 70 substantially adjacent/proximate the rail clamp engagement surface 80, the relief plate 32 is arranged within the recess or depression 72 of the rail clamp member 18.

Functionally, it will be appreciated that the first and second biasing members 34*a*, 34*b* may assist in pushing the rail clamp member 18 away from the base member 14 when the cam member 28 is orientated in an un-clamped orientation (see, e.g., FIGS. 5A-5C, 7A). In an embodiment, if the rail, R, is attached to a firearm, F, jarring forces imparted to the rail, R, and quick disconnect apparatus 10 could cause one or more of the base member 14 and rail clamp member 18 to bind to the rail, R when the cam member 28 is orientated at least partially to the clamped orientation (see, e.g., FIG. 7B); accordingly, the first and second biasing members 34*a*, 34*b* may also further assist in over-coming the binding of one or more of the base member 14 and the rail clamp member 18 to the rail, R, by pushing apart the base member 14 and rail clamp member 18 when the cam member 28 is adjusted from the clamped orientation to the un-clamped orientation.

Next, in an embodiment, the support bar 26 is inserted through the passage 78*b*, the passage 78*a* and then the passage 82*a*. Then, in an implementation, the support bar 26 may be rotated for the purpose of engaging the surface 86 of the stem portion 48 with the surface 84 of the passage 82*a* of the base member 14.

In an embodiment, it may be desirable to fix the support bar 26 with the base member 14 once the support bar 26 has engaged the base member 14. By fixing the support bar 26 with the base member 14, the support bar 26 may be prevented from rotating in a reverse direction/being uncoupled from the base member 14.

In an embodiment, to fix the support bar 26 with the base member 14, the support bar 26 and base member 14 may be swaged. In another embodiment, an adhesive, such as, for example, LOCTITE®, may be disposed upon one or more of the surfaces 84, 86 such that the surfaces 84, 86 may be subsequently bonded with one another.

Upon fixing the support bar 26 to the base member 14 as described above, the cam member 28 may be disposed relative the head portion 46 of the support bar 26. As seen in FIG. 1, the head portion 46 may also be formed to include a first, upper surface 88*a* and a second, lower surface 88*b*; in an embodiment, the surfaces 88*a*, 88*b* may be substantially flat/planar surfaces. Accordingly, upon arranging the cam member 28 relative the head portion 46, the head portion 46 may be located between the first and second flanges 56*a*, 56*b* such that the first, upper surface 88*a* may be disposed substantially adjacent the lower surface 58*a* of the first flange 56*a* and the second, lower surface 88*b* may be disposed substantially adjacent the upper surface 60*b* of the second flange 56*b*.

In an alternative embodiment for joining the support bar 26 to the base member 14, the stem portion 48 may be inserted through: the gap 62 of the cam member 28, the passage 78*b* of the relief plate, the passage 78*a* of the rail clamp member 18 and the passage 82*a* of the base member 14. In an embodiment, upon arranging the stem portion 48 as described above in the alternative embodiment, the head portion 46 of the support bar 26 may be ultimately disposed between the first and second flanges 56*a*, 56*b* of the cam member 28. Upon arranging the head portion 46 between the first and second flanges 56*a*, 56*b*, it will be appreciated that the contact of the surfaces 58*a*/88*a* and 60*b*/88*b* of the head portion 46 with the first and second flanges 56*a*, 56*b* prevent free rotation of the support bar 26 relative the cam member 28; however, it will also be appreciated that rotation of the cam member 28 results in a corresponding rotation of the support bar 26.

Upon arranging the head portion 46 between the first and second flanges 56*a*, 56*b* of the cam member 28 as described above in the alternative embodiment, the cam member 28 may be rotated in order to impart a rotational movement of the support bar 26 for the purpose of engaging the surface 86 of the stem portion 48 with the surface 84 of the passage 82*a* of the base member 14. As a result of the rotation of the cam member 28, the cam surfaces 66*a*, 66*b* may ultimately be located proximate/substantially adjacent the outer surface 74 of the relief plate 32. Thereafter, the support bar 26 may be fixed to the base member 14 in any desirable fashion described above (e.g., swaging, with an adhesive, or the like).

Irrespective of the attachment of the support bar 26 to the base member 14, the head portion 46 of the support bar 26 may be subsequently arranged between the flanges 56*a*, 56*b*/within the gap 62 of the cam member 28 such that the first passage 50 extending through the head portion 46 is at least partially aligned with both of the offset openings/passages 64*a*, 64*b* of each of the first and second flanges 56*a*, 56*b* of the cam member 28. Then, the pivot pin 30 is inserted through the offset opening/passage 64*a*, into the first passage 50 then through the offset opening/passage 64*b*.

In an embodiment, the pivot pin 30 may include an outer surface 90. In an embodiment, the outer surface 90 may include a first outer surface portion 90*a* having a first diameter and a second outer surface portion 90*b* having a second diameter. In an embodiment, the first diameter of the first outer surface portion 90*a* may be less than the diameter of the second outer surface portion 90*b*.

Further, in an embodiment, the diameter of the first outer surface portion 90*a* may be approximately equal to, but slightly less than the diameter of the second offset-opening/passage 64*b* such that the first outer surface portion 90*a* of the pivot pin 30 may frictionally-engage and become wedged within the second offset-opening/passage 64*b* at least proximate the first outer surface portion 90*a*. Further, in an embodiment, the diameter of the second outer surface portion 90*b* may be approximately equal to, but slightly less than the diameter of the first offset-opening/passage 64*a* such that the second outer surface portion 90*b* of the pivot pin 30 may frictionally-engage and become wedged within the first offset-opening/passage 64*a*. Although it has been described above that the diameter of the first and second outer surface portions 90*a*, 90*b* may be approximately equal to, but slightly less than the diameter of the offset opening/passages 64*a*, 64*b*, it will be appreciated that the diameters of the first and second outer surface portions 90*a*, 90*b* may be approximately equal to, but slightly greater than the diameter of the offset opening/passages 64*a*, 64*b*; however, in order to permit passage of the first and second outer surface portions 90*a*, 90*b* of the pivot pin 30 through the offset opening/passages 64*a*, 64*b*, it will be appreciated that, for example, material deformation of one or more of the pivot pin 30 and the first and second flanges 56*a*, 56*b* of the cam member 28 may occur to permit the pivot pin 30 to be positioned within the offset opening/passages 64*a*, 64*b*.

In an embodiment, prior to arranging the support bar 26 relative the base member 14, the rail clamping member 18, the relief plate 32 and the cam member 28 as described above, the adjustment member 24 may be at least partially engaged within the second passage 52 of the head portion 46. Accordingly, it will be appreciated that the adjustment member 24 may be removably-connected with the support bar 26 at any time during the assembling process/methodology.

Referring now to FIGS. 5A-7B, a method for utilizing the quick disconnect coupling 10 is described. The methodology generally has a two-step process including: (1) a fore/aft adjustment of an orientation of the cam member 28 and pivot pin 30 relative the support bar 26 (see, e.g., FIGS. 4A-4C) and (2) a rotational adjustment of the cam member 28 about the pivot pin 30 relative the support bar 26 for causing a change in fore/aft orientation of the rail clamp member 18 relative the base member 14 to/from an un-clamped orientation (see, e.g., FIG. 6A) and a clamped orientation (see, e.g., FIG. 6B).

Figure 5A:
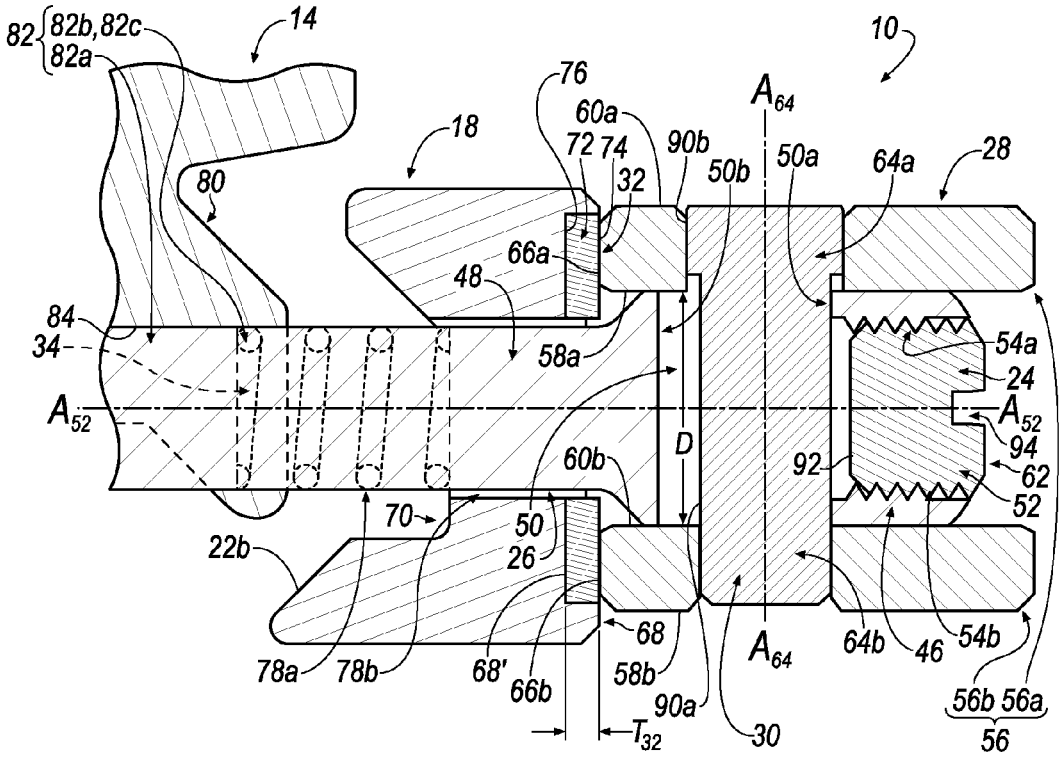
FIGS. 5A-5C illustrate cross-sectional views of the quick disconnect apparatus according to line 5-5 of FIG. 3 in accordance with an exemplary embodiment of the invention.
Figure 5B:
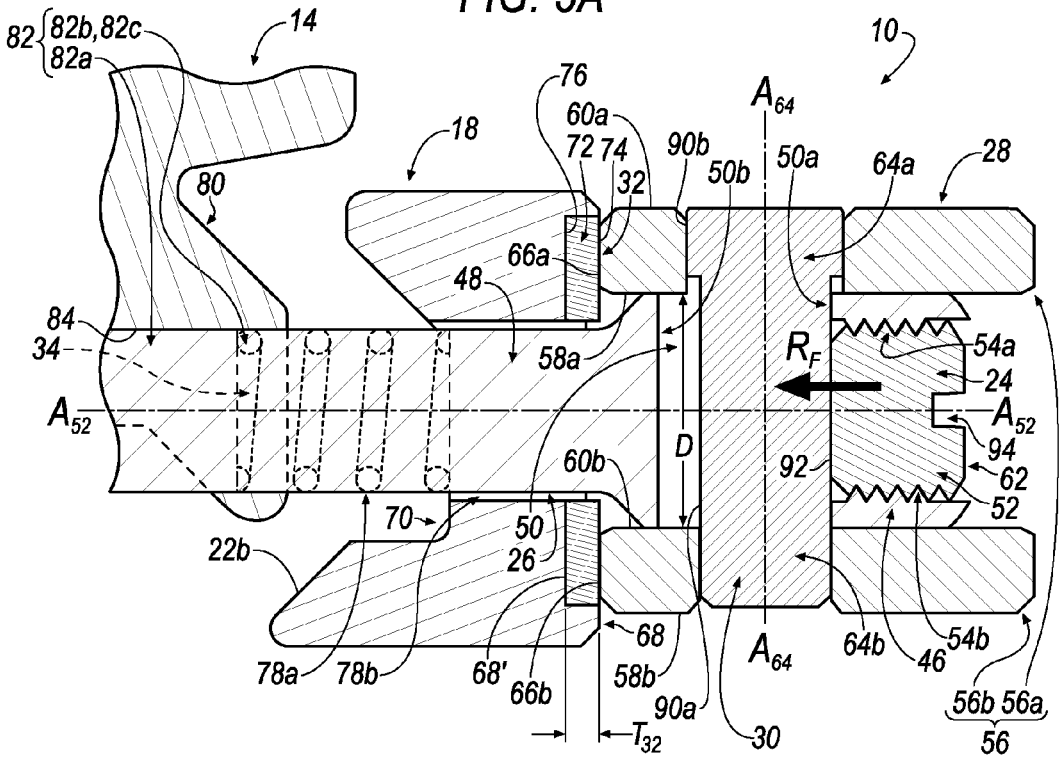
Figure 5C:
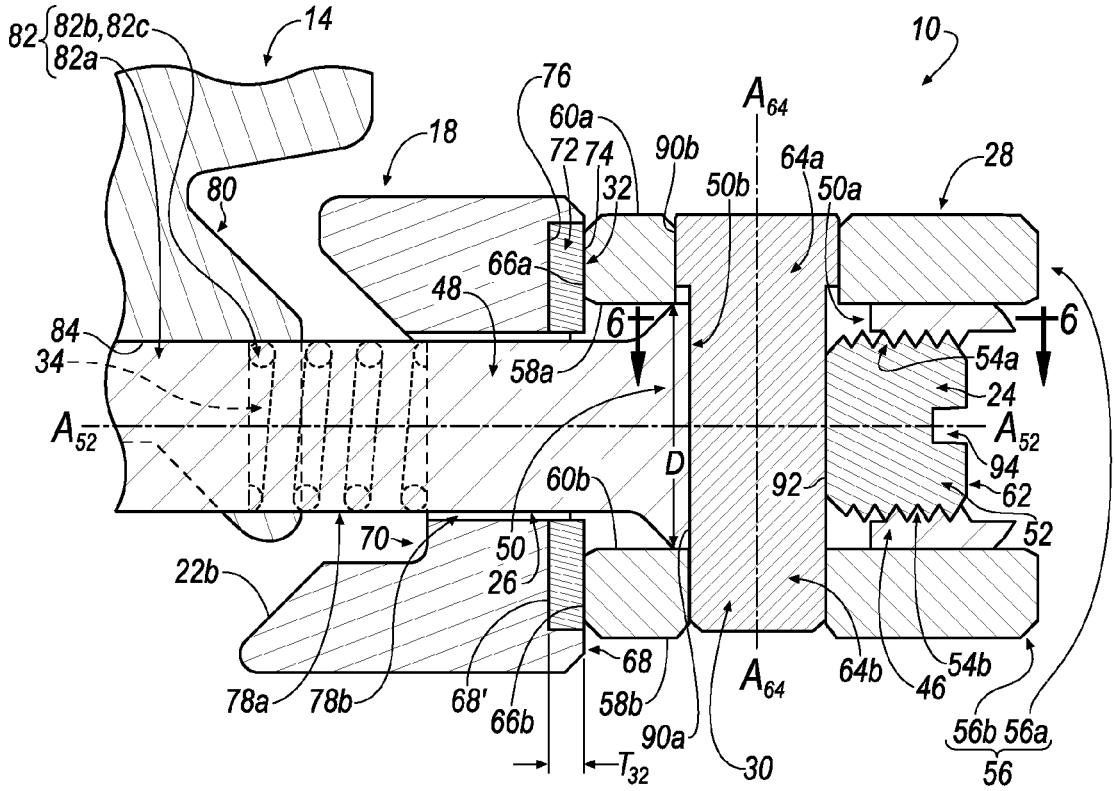

Referring now to FIGS. 5A-5C, a method for adjusting an orientation of at least a portion of the rail clamp adjustment device 44 is described according to an embodiment of the invention. Initially, as seen in each of FIGS. 5A-5C, the cam member 28 is located in an orientation such that the cam surfaces 66*a*, 66*b* come into contact with/engage the outer surface 74 of the relief plate 32 due to the first and second biasing members 34*a*, 34*b* biasing the rail clamp member 18 away from the base member 14.

As seen in FIGS. 5A-5C, because the first and second passages 50, 52 are in communication with one another, a portion (e.g., the first outer surface portion 90*a*) of the outer surface 90 of the pivot pin 30 is accessible from the second passage 52. Accordingly, when an orientation of the adjustment member 24 is adjusted within the second passage 52, a first end 92 of the adjustment member 24 may come into contact with/engage the first outer surface portion 90*a* of the pivot pin 30.

As seen in FIG. 5A, the adjustment member 24 is initially located in a dis-engaged orientation such that the first end 92 of the adjustment member 24 does not come in contact with/engage the first outer surface portion 90*a* of the pivot pin 30. Further, in an embodiment, the pivot pin 30 may be located relative the first passage 50 such that the first outer surface portion 90*a* of the pivot 30 engages a first end 50*a* of the first passage 50. In an embodiment, the first end 50*a* may be located farther away from the rail clamp member 18 in comparison to a second end 50*b* of the first passage 50 that is located closed to the rail clamp member 18.

Referring to FIG. 5B, a user may utilize a tool (not shown, e.g., a screw driver or an Allen wrench) to engage a second end 94 of the pin-adjusting screw 24 in order to rotate the adjustment member 24 relative the head portion 46 by way of the connection of 54*a*, 54*b*. As a result of the rotation of adjustment member 24, the first end 92 of the adjustment 24 contacts/engages the first outer surface portion 90*a* of the pivot pin 30, thereby applying a substantially radial force in the direction of arrow, $R_F$, to the first outer surface portion 90*a* of the pivot pin 30 relative the passage axis, $A_{64}$.

As a result of the application of the substantially radial force in the direction of arrow, $R_F$, the adjustment member 24 directly pushes the pivot pin 30 toward the rail clamp member 18, and, further, as a result of the coupling of the pivot pin 30 to the cam member 28 relative the support bar 26, the adjustment 24 also indirectly pushes the cam member 28 toward the rail clamp member 28. Accordingly, because the cam member 28 is joined to the support bar 26 by way of the pivot pin 30, the radial, pushing force, $R_F$, applied by the adjustment member 24 results in movement of both of the cam member 28 and pivot pin 30 relative the support bar 26 such that the pivot pin is moved away from the first end 50*a* of the first passage 50 and toward the second end 50*b* of the passage 50.

Referring to FIG. 5C, a user may further utilize the tool at the second end 94 of the adjustment member 24 in order to further rotate the adjustment member 24 relative the head portion 46 by way of the connection of the surfaces 54*a*, 54*b*. As a result of the further rotation of the adjustment member 24, the cam member 28 and the pivot pin 30 may be further moved relative the support bar 26. It will be appreciated, however, that movement of the cam member 28 and the pivot pin 30 toward the rail clamp member 18 is not infinite. As seen in FIG. 5C, the adjustment member 24 may be rotated to push the pivot pin 30 until the first outer surface portion 90*a* of the pivot pin 30 is advanced within the first passage 50 until a point when the first outer surface portion 90*a* engages the second end 50*b* of the first opening 50; accordingly, upon contact of the first outer surface portion 90*a* with the second end 50*b* of the first passage 50, further rotation of the adjustment member 24 is ceased.

Referring to FIG. 5, a partial top, cross-sectional view of the support bar 26 is shown according to an embodiment. For reference purposes with respect to an orientation of the pivot pin 30 described above in FIGS. 5A-5C, reference lines 5A, 5B and 5C are shown extending from a pivot pin 30, which is shown in phantom view (i.e., when the pivot pin 30 is located substantially adjacent to the first end 50*a* of the first passage 50, the reference line 4A extends from the pivot pin 30, and, when the pivot pin 30 is located substantially adjacent to the second end 50*b* of the first passage 50, the reference line 4C extends from the pivot pin 30). Further, it will be appreciated that in order to provide an un-obscured view of an embodiment of the geometry of the first passage 50 and relative location of the first outer surface portion 90*a* of the pivot pin 30 within the first passage 50 (according to the views of FIGS. 5A-5C), the cross-sectional reference line 6-6 referencing FIG. 6 in FIG. 5C is taken just below the cam member 28.

In an embodiment, as seen in FIG. 6, the first passage 50 includes an elongated, substantially oval/"ice rink" shape having an intermediate, substantially linear segment, L, and a pair of arcuate, rounded end segments having a radius, R1, R2. It will be appreciated, however, that the geometry of the first passage 50 is not limited to including the illustrated geometry and that the first passage 50 may include other geometries, such as, for example, triangular geometries and the like.

Figure 7A:
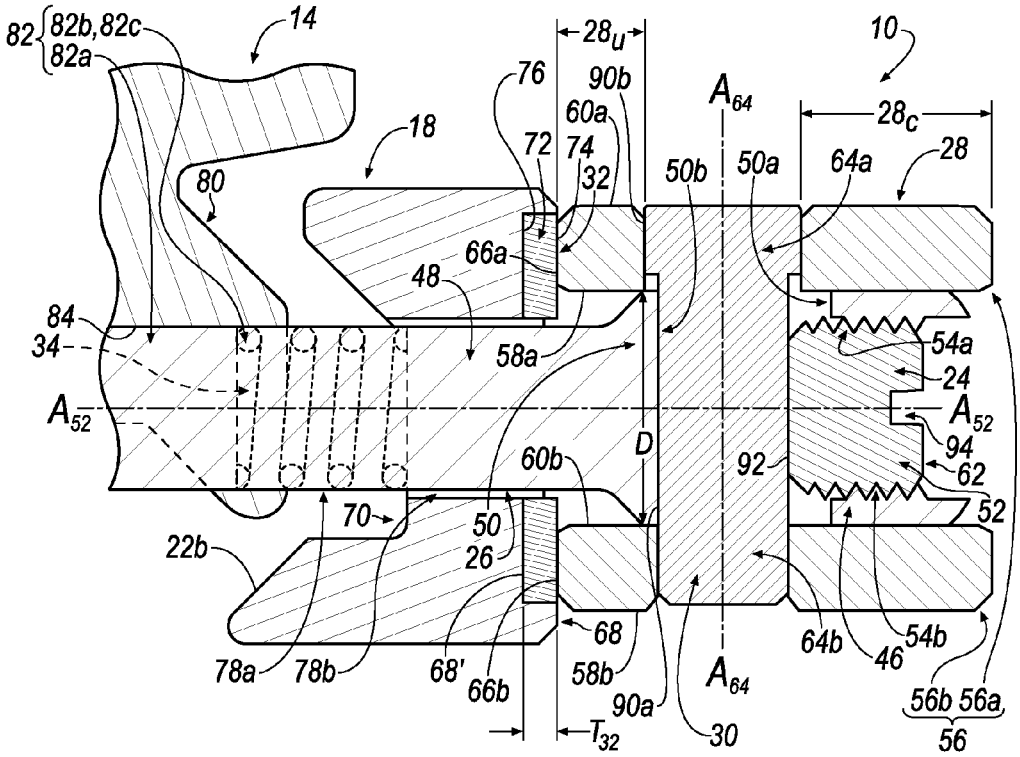
FIGS. 7A-7B illustrate cross-sectional views of the quick disconnect apparatus in reference to line 7B-7B of FIG. 3 in accordance with an exemplary embodiment of the invention.
Figure 7B:
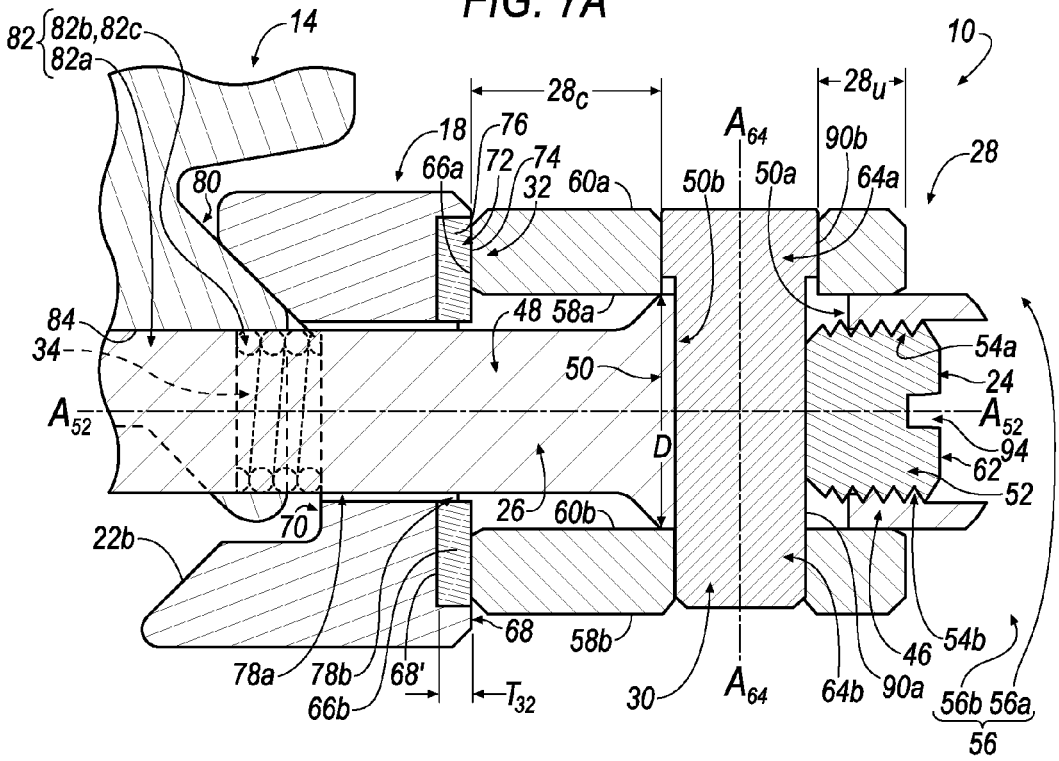

Referring now to FIGS. 7A and 7B, an embodiment of an adjustment of an orientation of cam member 28 and rail clamp member 18 is described. Initially, referring to FIG. 7A, the cam surfaces 66*a*, 66*b* are shown contacting the outer surface 74 of the relief plate 32 when the rail clamp member 18 may be said to be located relative the base member 14 in an "un-clamped orientation." As seen in FIG. 7B, the cam surfaces 66*a*, 66*b* are still in contact with the outer surface 74 of the relief plate 32 when the rail clamp member 18 may be said to be located relative the base member 14 in at least a partially "clamped orientation" (see also FIGS. 3-4). In an embodiment, the substantially constant contact of the cam surfaces 66*a*, 66*b* with the relief plate 32 is provided by way of the one or more biasing members 34 biasing the rail clamp member 18 and relief plate 32 toward the cam member 28.

Referring to FIG. 3, an offset orientation of the first and second offset openings/passages 64*a*, 64*b* formed by the first and second flanges 56*a*, 56*b* of the cam member 28 results in the cam surfaces 66*a*, 66*b* being progressively spaced apart from the first and second offset openings/passages 64*a*, 64*b*. In an embodiment, as seen in FIG. 3, a maximum and a minimum spacing of the cam surfaces 66*a*, 66*b* and the first and second offset openings/passages 64*a*, 64*b* are identified at $\mathbf{28}_C$, $\mathbf{28}_U$.

In an embodiment, as seen in FIGS. 3 and 7B, when the cam member 28 is rotated, C, in order to locate the maximum spacing $\mathbf{28}_C$ of the cam surfaces 66*a*, 66*b* and first and second offset openings/passages 64*a*, 64*b* closest to the rail clamp member 18, the cam member 28 causes the rail clamp member 18 to be moved toward the base member 14 such that the rail clamp member 18 and the base member 14 may be said to be located in at least the partially "clamped orientation."

As seen in FIG. 7B, although the inner surface 70 of the rail clamp member 18 and the rail clamp engagement surface 80 of the base member 14 are shown to be substantially contacting one-another, it will be appreciated that the surfaces 70, 80 do not necessarily have to contact one another in order for the rail clamp member 18 and the base member 14 to be said to be in the at least partially or fully "clamped orientation;" for example, if a rail, R, includes a larger than usual tolerance or outer surface profile/geometry, $R_P$, the surfaces 70, 80 of the rail clamp member 18 and the base member 14 may be spaced apart from one another although the rail clamp member 18 and the base member 14 may both engage and clamp at least a portion of the outer surface profile/geometry, $R_P$, of the rail, R. Further, it will be appreciated that as the rail clamp member 18 is moved toward the base member 14 by way of rotation of the cam member 28, the first and second biasing spring members 34*a*, 34*b* become at least partially compressed by the rail clamp member 18 and the base member 14 such that the first and second biasing spring members 34*a*, 34*b* store energy as the first and second biasing spring members 34*a*, 34*b* are increasingly-orientated from a substantially un-biased orientation (see, e.g., FIG. 7A) to a biased orientation (see, e.g., FIG. 7B).

As seen in FIG. 7A, when the cam member 28 is rotated, U (see, e.g., FIG. 2), in order to locate the minimum spaced $\mathbf{28}_U$ of the cam surfaces 66*a*, 66*b* and the first and second offset openings/passages 64*a*, 64*b* closest to the rail clamp member 18, energy stored by the first and second biasing spring members 34*a*, 34*b* (as a result of being re-orientated from a substantially biased orientation to the substantially unbiased orientation) is released such that the first and second biasing spring members 34*a*, 34*b* push the rail clamp member 18 away from the base member 14. Accordingly, because the rail clamp member 18 is moved away from the base member 14, the rail clamp member 18 and the base member 14 may be said to be located in the "un-clamped orientation" as a result of one or more of the cam member 28 being rotated according to the direction of the arrow, U, and the first and second biasing spring members 34*a*, 34*b* pushing the rail clamp member 18 away from the base member 14. In an embodiment, rotation of the cam member 28 according to the direction of the arrows, C, U, may be conducted by grasping and pushing/pulling the lever 57.

In an embodiment, if the rail clamp member 18 and base member 14 are to be selectively-coupled to the rail, R, the following steps precede rotation of the cam member according to the direction of the arrow, C. Firstly, the rail clamp member 18 and the base member 14 are located in the "un-clamped orientation" by rotating the cam member 28 according to the direction of the arrow, U. Then, the outer surface profile/geometry, $R_P$, of the rail, R, is arranged relative or substantially proximate/adjacent one or more of the surface profile/geometry 22*a*, 22*b* of the rail clamp member 18 and the base member 14. Then, upon locating the rail, R, relative or substantially proximate/adjacent one or more of the surface profiles/geometries 22*a*, 22*b*, the cam member 28 is rotated according to the direction of the arrow, C, for causing the rail clamp member 18 and the base member 14 to be located in at least a partially "clamped orientation."

In an embodiment, it will be appreciated that the geometry of the first passage 50 of the support bar 26 may further accommodate different widths/tolerances associated with the outer surface profile/geometry, $R_P$, of the rail, R. As described above, when the cam member 28 is rotated, C/U, in order to cause the rail clamp member 18 and the base member 14 to be located in one of an "un-clamped orientation," a "partially clamped orientation" and a "clamped orientation," the pin-adjusting screw 24 may be rotated in order to adjust/"fine tune" a fore/aft orientation of the pivot pin 30 and cam member 28 relative the base member 14; Such an adjustment/"fine tuning" may aid in the compensation of rails, R, having different widths, geometries or the like by permitting the pivot pin 30 to travel in a fore/aft direction within the first passage 50 as the cam member 28, which is coupled to the pivot pin 30 is correspondingly-moved with the pivot pin 30.

Figure 8:
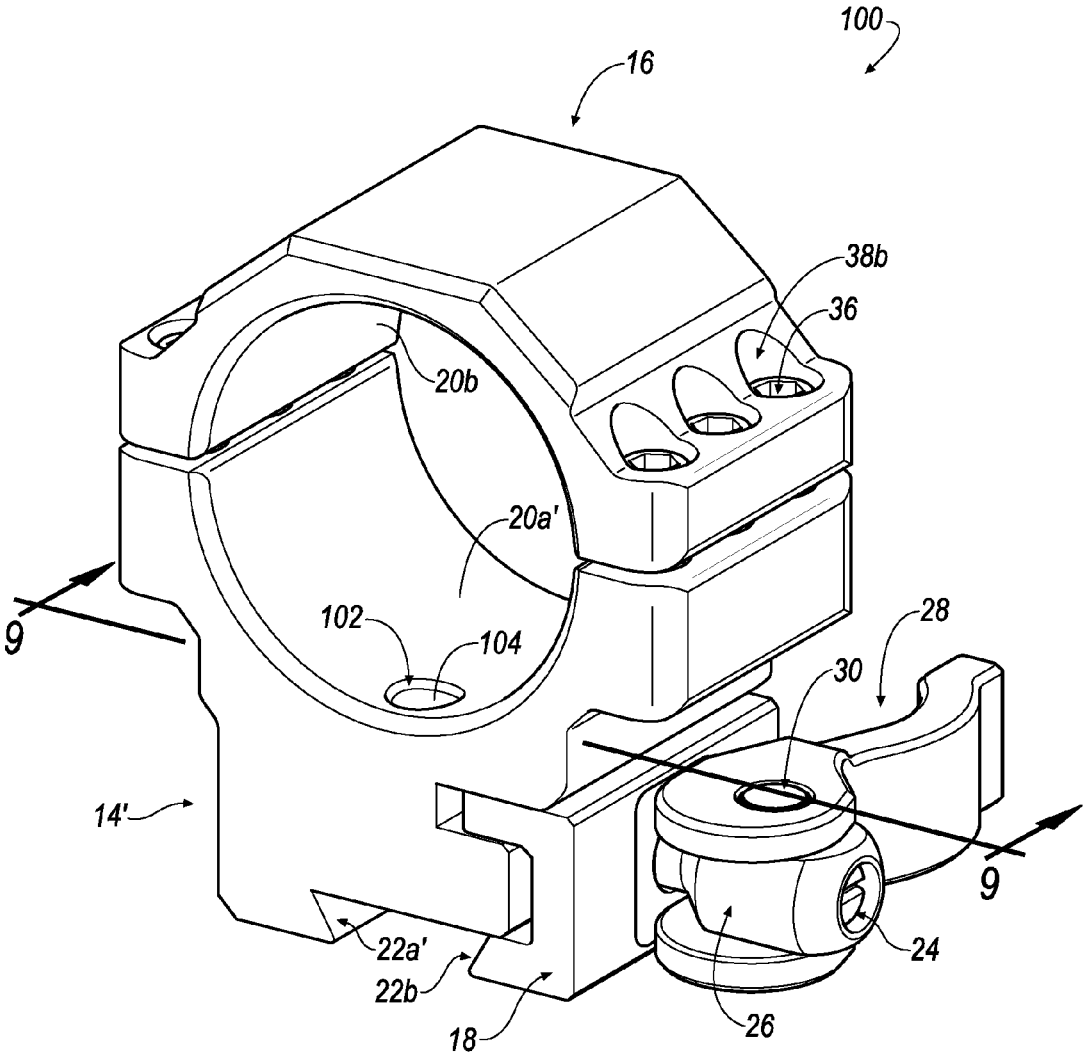
FIG. 8 illustrates an assembled view of a quick disconnect apparatus in accordance with an exemplary embodiment of the invention.

Referring to FIG. 8, a quick disconnect apparatus 100 is shown according to an embodiment of the invention. The quick disconnect apparatus 100 is substantially similar to the quick disconnect apparatus 10 and therefore, for brevity purposes, is not described in greater detail here. However, as seen in FIGS. 8-9, the quick disconnect apparatus 100 is differentiated from the quick disconnect apparatus 10 in that the quick disconnect apparatus 100 includes a base member 14' having a different configuration than the base member 14.

In an embodiment, the base member 14' includes a passage 102 that extends through the base member 14' between the surface profile/geometry 20*a*' and the surface profile/geometry 22*a*'. In an embodiment, the passage 102 is formed by a surface 104. In an embodiment, at least a portion of the surface 104 includes a threaded surface 106 (see, e.g., FIG. 8).

Figure 9:
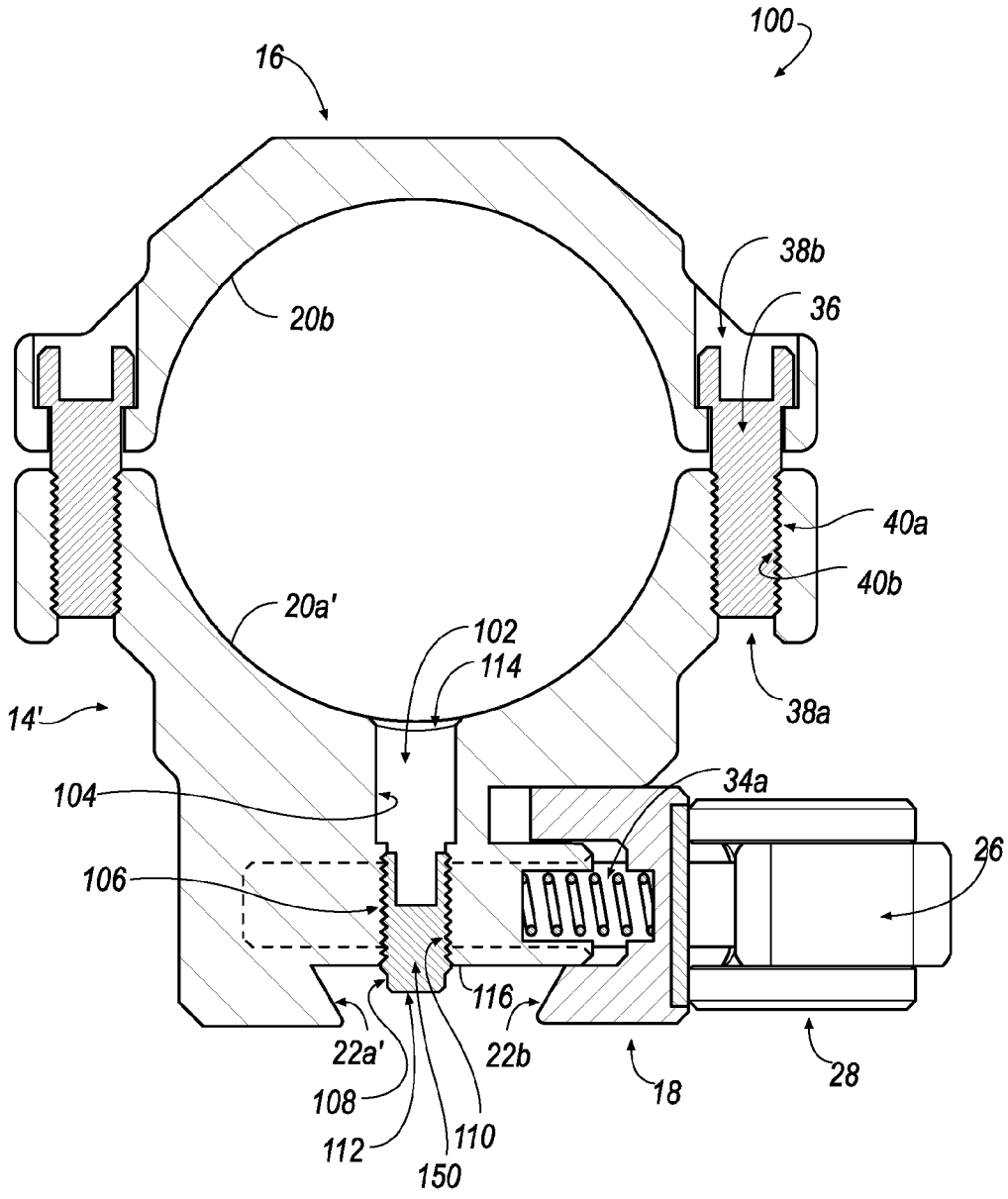
FIG. 9 illustrates a front, partial cross-sectional view of the quick disconnect apparatus according to line 9-9 of FIG. 8 in accordance with an exemplary embodiment of the invention.

Referring to FIG. 9, in an embodiment, the quick disconnect apparatus 100 also includes a rail-engagement pin 150. In an embodiment, at least a portion of an outer surface 108 of the rail-engagement pin 150 includes a threaded surface 110. In an embodiment, the threaded surface 110 of the rail-engagement pin 150 cooperates with the threaded surface 106 of the passage 102 in order to permit the rail-engagement pin 150 to be threadingly-coupled to the base member 14'.

In an embodiment, the rail-engagement pin 150 may be inserted into the passage 102 from an opening 114 formed in the surface profile/geometry 20*a*'. Rotation of the rail-engagement pin 150 by way of, for example, a tool (not shown) that is engagable with the rail-engagement pin 150 permits further advancement of the rail-engagement pin 150 through the passage 102 as a result of the cooperation of the threaded surfaces 106, 110. Advancement of the rail-engagement pin 150 through the passage 102 may cease when a leading end 112 of the rail-engagement pin 150 engages a portion of the outer surface profile/geometry, $R_P$, of a rail, R.

In an embodiment, contact of the leading end 112 of the rail-engagement pin 150 with the portion of the outer surface profile/geometry, $R_P$, of a rail, R, may occur after the quick disconnect apparatus 100 is at least partially clamped with the rail, R, by rotating the cam member 28 according to the direction according to the arrow, C, as described above. Functionally, it will be appreciated that engagement/contact of the leading end 112 of the rail-engagement pin 150 with the rail, R, may increase surface contact of the quick disconnect apparatus 100 with the rail, if, for example, the outer surface profile/geometry, $R_P$, of the rail, R, does not come into contact with a laterally-extending/"bridge" surface 116 of the combination of the surface profiles/geometries 22*a*', 22*b* forming the dovetail-receiving passage or gap of the quick disconnect apparatus 100.

Referring to FIGS. 10-17, another embodiment of a quick disconnect apparatus is shown and described. The quick disconnect apparatus 200 is generally similar to the quick disconnect apparatus 10, 200 and therefore, for brevity purposes, variations in features will only be discussed hereinafter. FIG. 10 depicts an alternate support bar 202. In the disclosed implementation, the support bar 202 includes a first end portion 204, a second end portion 206 and an intermediate portion 208 between first end portion 204 and second end portion 206. In the described embodiment, second passage 52 (as described above) and adjustment member 24 may be omitted as will become apparent based on the description below.

As illustrated, at least a portion of the first end portion 204 may be knurled or otherwise splined and second end portion 206 may define a passage 210. In an implementation, inner surface 84' of first recess 82*a* is formatted to frictionally accept the knurled/splined first end portion 204. In an implementation, and as depicted, inner surface 84' is substantially smooth. It is to be appreciated, however, that other embodiments may provide an inner surface 84' that includes corresponding splines or other features to interact with knurled/splined first end portion 204.

With continued reference to FIG. 10 and additional reference to FIGS. 12-17, the support bar 202 is lockingly secured within base member 14' to provide a means to retain support bar 202 within base member 14'. In an implementation, support bar 202 defines a keyed recess 212, or notch about intermediate portion 208. A retention member 214 is provided to selectively engage one or more shoulders of keyed recess 212 to prevent axial movement of support bar 202 when retention member 214 is added. In an implementation, the retention member 214 is press-fit into position. As depicted in FIG. 17, a cover 216 may be further provided to allow selective access to one or all of keyed recess 12 or retention member.

The embodiments disclosed herein have been discussed for the purpose of familiarizing the reader with novel aspects of the invention. Although preferred embodiments of the invention have been shown and described, many changes, modifications and substitutions may be made by one having ordinary skill in the art without necessarily departing from the spirit and scope of the invention as described in the following claims.

What is claimed is:

1. A quick disconnect apparatus, comprising:

a base member including at least one passage;

a rail clamp member including a support bar receiving passage, wherein the rail clamp member is movably-coupled to the base member; and a rail clamp adjustment device coupled to at least one of the base member and rail clamp member, wherein the rail clamp adjustment device includes a pivot pin, a cam member including at least one offset passage, and a support bar including a pivot-pin receiving passage, wherein the support bar extends through the support bar receiving passage of the rail clamp member and a passage of the at least one passage of the base member to movably-couple the rail clamp member with the base member, wherein the pivot pin is inserted through the at least one offset passage of the cam member and the pivot-pin receiving passage of the support bar to rotatably-couple the cam member relative the support bar, wherein the cam member includes at least one cam surface, wherein the rail clamp member includes an outer surface, wherein the at least one cam surface engages the outer surface of the rail clamp member.

2. The quick disconnect apparatus according to claim 1, wherein the at least one passage of the base member further includes at least one biasing member receiving passage, wherein the at least one biasing member receiving passage permits receipt of a biasing member, wherein the biasing member engages an inner surface of the rail clamp member, wherein the biasing member provides means for biasing the rail clam member away from the base member.

3. The quick disconnect apparatus according to claim 2, wherein, when the cam member is arranged to locate a maximum spacing between the at least one cam surface and the at least one offset passage closer to the rail clamp member rather than a minimum spacing between the at least one cam surface and the at least one offset passage closer to the rail clamp member such that the cam member provides means for overcoming the biasing of the rail clamp member away from the base member by the biasing member, and movably-arranging the rail clamp member closer to the base member such that the rail clamp member is arranged in at least a partially clamped orientation relative the base member.

4. The quick disconnect apparatus according to claim 2, wherein, when the cam member is arranged to locate a minimum spacing between the at least one cam surface and the at least one offset passage closer to the rail clamp member rather than a maximum spacing between the at least one cam surface and the at least one offset passage closer to the rail clamp member such that the cam member provides means for permitting the biasing of the rail clamp member away from the base member by the biasing member and movably-arranging the rail clamp member away from the base member such that the rail clamp member is arranged in at least a partially un-clamped orientation relative the base member.

5. The quick disconnect apparatus according to claim 1, wherein the pivot-pin passage includes an elongated geometry that provides means for permitting travel of the pivot pin relative the support bar.

6. The quick disconnect apparatus according to claim 5, wherein the rail clamp adjustment device further comprises an adjustment member, wherein the support bar includes a passage engaging the adjustment member.

7. The quick disconnect apparatus according to claim 6, wherein the adjustment member is adjustably-disposed within the passage to provide means for permitting an end of the pin-adjusting screw member to engage an outer surface portion of the pivot pin for permitting fore/aft travel of the pivot pin within the pivot-pin passage of the support bar such that a fore/aft orientation of both of the pivot pin and the cam member may be adjusted relative the support bar.

8. The quick disconnect apparatus according to claim 1, further comprising:

an accessory clamp member removably-coupled to the base member, wherein coupling of the accessory clamp member to the base member provides means for selectively-retaining an accessory to the quick disconnect apparatus, wherein coupling of the rail clamp member to the base member provides means for selectively-retaining the quick disconnect apparatus to a rail.

9. The quick disconnect apparatus according to claim 8, wherein the rail is a Picatinny rail having a dove-tail shaped outer surface profile/geometry, wherein the base member and the rail clamp member each include a surface profile/geometry that conforms to at least a portion of the dove-tail shaped outer surface profile/geometry of the rail.

10. The quick disconnect apparatus according to claim 9, wherein the rail is connected to a firearm.

11. The quick disconnect apparatus according to claim 1, wherein the wherein the outer surface of the rail clamp member includes a depression forming a recessed outer surface portion of the outer surface of the rail clamp member, wherein support bar receiving passage is formed in the recessed outer surface portion.

12. The quick disconnect apparatus according to claim 11, further comprising:

a relief plate disposed within the depression, wherein the relief plate is disposed substantially adjacent the recessed outer surface portion of the rail clamp member, wherein the relief plate includes a support bar receiving passage coaxially-aligned with the support bar receiving passage of the rail clamp member, wherein the at least one cam surface engages an outer surface of the relief plate for indirectly engaging the outer surface of the rail clamp member.

13. The quick disconnect apparatus according to claim 1, further comprising:

a rail-engagement pin, wherein the base member includes a rail-engagement pin receiving passage, wherein the rail engagement pin is adjustably-disposed within the rail-engagement pin receiving passage to permit an end of the rail-engagement pin to engage an outer surface profile/geometry of a rail.

14. The quick disconnect apparatus according to claim 13, wherein the rail is a Picatinny rail having a dove-tail shaped outer surface profile/geometry, wherein the rail is connected to a firearm.

15. The quick disconnect apparatus according to claim 1, wherein the support bar is lockingly secured to the base member.

16. The quick disconnect apparatus according to claim 15, further comprising:

a retention member in locking engagement between the base member and a shoulder defined by the support bar such that the retention member and the shoulder lockingly secure the support member to the base member.

17. The quick disconnect apparatus according to claim 1, wherein the support bar includes a first end portion and a second end portion, wherein the first end portion defines a knurled/splined portion.

18. The quick disconnect apparatus according to claim 17, wherein the base member defines a passage circumscribed by a wall and wherein at least a portion of the knurled/splined portion of the support bar is frictionally engaged with the wall of the passage.

19. The quick disconnect apparatus according to claim 18, wherein the passage includes splines that correspond with the knurled/splined portion of the support bar.

* * * * *

UNITED STATES PATENT AND TRADEMARK OFFICE

CERTIFICATE OF CORRECTION

PATENT NO. : 8,397,421 B2
APPLICATION NO. : 13/074397
DATED : March 19, 2013
INVENTOR(S) : Tai-Lai Ding et al.

It is certified that error appears in the above-identified patent and that said Letters Patent is hereby corrected as shown below:

In the Specification:

At column 2, line number 12, delete “16-16” and insert -- 17-17 --;

At column 4, line number 53, delete “FIGS. 4A-4C” and insert -- FIGS. 5A-5C --;

At column 8, line number 59, delete “FIGS. 4A-4C” and insert -- FIGS. 5A-5C --;

At column 9, line number 44, delete “28” and insert -- 18 --;

At column 11, line number 17, delete “FIG. 2” and insert -- FIG. 3 --.

Signed and Sealed this
Twenty-first Day of May, 2013

Teresa Stanek Rea
*Acting Director of the United States Patent and Trademark Office*